US005650810A

United States Patent [19]

Muto

[11] Patent Number: 5,650,810

[45] Date of Patent: Jul. 22, 1997

[54] INK JET PRINT HEAD HAVING A MANIFOLD WALL PORTION AND METHOD OF PRODUCING THE SAME BY INJECTION MOLDING

[75] Inventor: Mitsuru Muto, Kasugai, Japan

[73] Assignee: Brother Kogyo Kabushiki Kaisha, Nagoya, Japan

[21] Appl. No.: 159,685

[22] Filed: Dec. 1, 1993

[30] Foreign Application Priority Data

| | | | |
|---|---|---|---|
| Dec. 3, 1992 | [JP] | Japan | 4-324275 |
| Dec. 3, 1992 | [JP] | Japan | 4-324276 |
| Jan. 20, 1993 | [JP] | Japan | 5-007654 |

[51] Int. Cl.[6] ..... B41J 2/045

[52] U.S. Cl. ..... 347/71; 347/20; 347/69; 29/25.35; 29/890.1; 264/328.1

[58] Field of Search ..... 347/68–72, 20; 310/328, 330; 29/25.35, 890.1; 264/56, 63, 328.1

[56] References Cited

U.S. PATENT DOCUMENTS

| | | | |
|---|---|---|---|
| 4,434,430 | 2/1984 | Koto | 347/70 |
| 4,879,568 | 11/1989 | Bartky et al. | 347/69 |
| 4,887,100 | 12/1989 | Michaelis et al. | 347/69 |
| 5,016,028 | 5/1991 | Temple | 347/69 |
| 5,410,341 | 4/1995 | Sugahara et al. | 347/69 |
| 5,430,344 | 7/1995 | Takeuchi et al. | 310/330 |

FOREIGN PATENT DOCUMENTS

| | | | |
|---|---|---|---|
| 0516284A2 | 12/1992 | European Pat. Off. | B41J 2/045 |
| 56-080476 | 7/1981 | Japan . | |
| 59-215778 | 12/1984 | Japan . | |
| 63-247051 | 10/1988 | Japan | B41J 2/045 |
| 63-252750 | 10/1988 | Japan | B41J 2/045 |
| 2-150355 | 6/1990 | Japan | B41J 2/045 |
| 3162963 | 7/1991 | Japan . | |
| 4168052 | 6/1992 | Japan . | |
| 4-185345 | 7/1992 | Japan | 347/71 |
| 4-275154 | 9/1992 | Japan | 347/71 |

*Primary Examiner*—Benjamin R. Fuller
*Assistant Examiner*—Charlene Dickens
*Attorney, Agent, or Firm*—Oliff & Berridge

[57] ABSTRACT

An ink ejection device for ejecting ink comprises: a piezoelectric ceramic plate for defining an ink channel for containing ink, the piezoelectric ceramic plate deforming by application of an electric voltage thereto so as to change the volume in the ink channel and eject ink from the ink channel, the piezoelectric ceramic plate being formed by injection molding so that the piezoelectric ceramic plate having one surface with a surface roughness Rz (defined in Japanese Industrial Standard "JIS B 0601") of 1 μm or less; and a metal electrode provided on the surface of the piezoelectric ceramic plate for applying the electric voltage to the piezoelectric ceramic plate.

12 Claims, 13 Drawing Sheets

INK JET PRINT HEAD HAVING A MANIFOLD WALL PORTION AND METHOD OF PRODUCING THE SAME BY INJECTION MOLDING

BACKGROUND OF THE INVENTION

1. Field of the Invention

The present invention relates to an ink jet print head for ejecting ink by the deformation of a piezoelectric ceramic element by application of a voltage, and a method of producing the same.

2. Description of the Related Art

Conventionally, there has been provided an ink jet print head which uses a piezoelectric ceramic element. An example is a drop-on-demand type ink jet print head with ink filled channels (ink channels) wherein the volume in the ink channels changes with deformation of the piezoelectric ceramic element. When the volume reduces, this device ejects ink in an ink channel from a nozzle as a liquid droplet. When the volume increases, ink from an ink introduction port is introduced to the channel. By causing an ink droplet to be ejected from an ink channel as required by incoming print data, a desired character or image is formed on, for example, paper opposing the ink jet print head.

This type of ink jet print head is described in Japanese Patent Application Kokai Nos. SHO63-247051, SHO63-252750, and HEI2-150355.

Conventionally, this type of ink jet print head is used, for example, in ink jet printers. A first example of a conventional ink jet print head wherein a piezoelectric ceramic element 76 is provided to a sidewall 74 of a housing 72 forming an ink chamber 70 will be explained while referring to FIG. 1.

In order to produce the piezoelectric ceramic element 76, a piezoelectric ceramic sheet is first formed from piezoelectric ceramic powder using such techniques as tape casting processes or extrusion processes. The piezoelectric ceramic sheet is cut to a predetermined size and is sintered at a predetermined temperature to obtain a piezoelectric ceramic sinter. Grinding processes are performed to smooth the surface of the piezoelectric ceramic sinter to a uniform flatness. The piezoelectric ceramic sinter is then polarized. Thus, the piezoelectric ceramic element 76 is obtained. Electrodes 77 are formed to both surfaces 90 of the piezoelectric ceramic element 76. A drive circuit 79 is connected to the electrodes 77.

Thus produced piezoelectric ceramic element 76 deforms when the drive circuit 79 applies a drive voltage to the electrode 77. As indicated by the single-dot chain line, the sidewall 74 deforms with deformation of the piezoelectric ceramic element 76, reducing the volume of the ink chamber 70 and thereby ejecting the ejection liquid, ink in this example, filling the ink chamber 70 from the nozzle 82 as an ink droplet 80. Afterward, when application of the drive voltage stops, the piezoelectric ceramic element 76 reverts to its shape prior to deformation, increasing the volume of the ink chamber 70 so that ink flows from the ink supply channel 84 into the ink chamber 70. A plurality of these ink chambers 70 are provided in an array when the device is used in an ink jet printer.

A second conventional example of a conventional ink jet print head 1 as described in Japanese Patent Application Kokai No. HEI2-150355 includes a piezoelectric ceramic plate 2; a cover plate 3; a nozzle plate 31; and a substrate 41 as shown in FIG. 2. To produce this ink jet print head 1, a piezoelectric ceramic element is first formed in the same way as described in the first conventional example. A plurality of grooves 8 are cut into the piezoelectric ceramic element using, for example, a thin, disk-shaped diamond blade, to form the piezoelectric ceramic plate 2. The grooves 8 are cut parallel to each other and to equal depths so as to become gradually shallower in progressing toward the end 15 of the piezoelectric ceramic plate 2. The depth of each groove 8 decreases thus becoming a shallow groove 16 near the end 15. The sidewalls 11, which form the side surfaces of the grooves 8, are polarized in the direction labeled by the arrow 5 in FIGS. 3*a* and 3*b*. A metal electrode 13 is formed by sputtering along the upper half of both side surfaces of each groove 8. A metal electrode 9 is formed by sputtering on the side and bottom surfaces of the inner surface of the shallow groove 16. Thus the metal electrode 9 formed in the shallow groove 16 connects the two metal electrodes 13 formed to side surfaces of the groove 8.

The cover plate 3 is formed from, for example, a ceramic material or a resin material. An ink introduction port 21 and a manifold 22 are cut or ground into the cover plate 3. An epoxy-type adhesive 4, for example, is used to bond the surface of the cover plate 3 containing the manifold 22 to the surface of the piezoelectric ceramic plate 2 containing the grooves 8. As a result, the cover plate 3 covers the grooves 8 thereby forming in the ink jet print head 1 a plurality of ink channels 12 having a mutual interval in the horizontal direction. As shown in FIG. 3*a*, the ink channels 12 are long and narrow in rectangular cross section. All the ink channels are filled with ink.

The nozzle plate 31 provided with nozzles 32 is adhered to the end of the piezoelectric ceramic plate 2 and the cover plate 3. The nozzles 32 are positioned so that the positions of each nozzle 32 will correspond to the position of its respective ink channel 12. The nozzle plate 31 is formed from a plastic such as polyalkylene terephthalate (for example, polyethylene terephthalate), polyimide, polyether imide, polyether ketone, polyether sulfone, polycarbonate, or cellulose acetate.

The substrate 41 is attached by, for example, an epoxy adhesive to the non-grooved side of the piezoelectric ceramic plate 2. A conductor layer 42 is formed to the substrate 41 in a pattern corresponding to positions of the ink channels 12. An individual conductor wire 43 is connected by wire bonding between each metal electrode 9 in each shallow groove 16 and its corresponding conductor layer pattern 42.

An explanation of the construction of a control portion for driving the ink jet print head of FIG. 2 will be provided while referring to the block diagram of the control portion in FIG. 4. The conductor layer pattern 42 formed in the substrate 41 are individually connected to an LSI chip 51. A clock line 52, a data line 53, a voltage line 54, and a ground line 55 are also connected to the LSI chip 51. Based on the clock pulse consecutively supplied from the clock line 52, the LSI chip 51 determines when ink should be ejected from which nozzles 32 according to data from the data line 53. A voltage V from the voltage line 54 is applied to the conductor layer pattern 42 in continuity with the metal electrode 13 within the driven ink channel 12. A 0 V voltage from the ground line 55 is applied to conductor layer patterns 42 not in continuity with driven ink channels.

An explanation will be provided on the operation of the ink jet print head 1 while referring to FIGS. 3*a* and 3*b*. Now assume that the LSI chip 51 determines to eject ink from ink channel 12*b* in the ink jet print head 1 according to incoming data. The LSI chip therefore applies a positive drive voltage V to metal electrodes 13*e* and 13*f* and grounds metal electrodes 13*d* and 13*g*. As shown in FIG. 3*b*, drive electric fields are generated in the sidewalls 11*b* and 11*c* in directions indicated by arrows 14*b* and 14*c* respectively. Because the drive electric field directions 14*b* and 14*c* are orthogonal to the direction of polarization 5, a piezoelectric thickness shear effect causes the sidewalls 11*b* and 11*c* to rapidly deform, in this case, in the inward direction of the ink channel 12*b*. This deformation reduces the volume of the ink channel 12*b*, rapidly increases the pressure in the ink, generates a pressure wave, and ejects an ink droplet from the nozzle 32 (see FIG. 2) communicating with the ink channel 12*b*.

When application of the drive voltage V stops, because the sidewalls 11*b* and 11*c* gradually regain their predeformation shape (see FIG. 3*a*), the ink pressure within the ink channel 12*b* gradually decreases. When this happens, ink is supplied to the ink channel 12*b* from the ink supply port 21 (see FIG. 2) through the manifold 22 (see FIG. 2).

An explanation of the construction of an ink jet printer in which the ink jet print head 1 of FIG. 2 is employed will be provided while referring to FIG. 5. The above-described ink jet print head 1 and an ink reservoir 61 are both mounted on a carriage 62. The print head 1 and the ink reservoir 61 are connected so as to connect the inner portion of the ink reservoir 61 with the ink introduction port 21 (see FIG. 2) of the ink jet print head 1. When ink within the ink reservoir 61 is exhausted, the ink reservoir 61 is detached from the carriage 62, and replaced with a new one. The carriage 62 returnably moves along the slider 63. The ink jet print head 1 prints characters on a recording paper 66 supported on a platen 64. Paper feed rollers 65*a* and 65*b* move the recording paper 66 in a direction orthogonal to the direction in which the carriage 62 is moved. Because of this, the ink jet print head 1 can print characters anywhere on the surface of the recording paper 66.

This type of ink jet print head 1 produces a spray of small ink droplets each time an ink droplet is ejected. A portion of this spray becomes attached to the nozzle plate 31. Left alone, ink will accumulate gradually on the surface of the nozzle plate 31, preventing ejection of ink droplets. A moderate period after printing of characters is completed, or after printing is completed, the carriage 62 is moved to the left side of the printer into a non-printing area. A wiper 68, formed from, for example, resin or cotton fibers, is provided to a support member 69 fixed in the non-printing area. The wiper 68 engages or contacts the surface of the nozzle plate 31 as the print head moves left. This sweeping movement causes the wiper 68 to remove ink spray attached to the nozzle plate 31. The wiper 68 is replaced when a large amount of ink accumulates thereon.

The wiper 68 can also be provided to a movable member, and caused to wipe the surface of the nozzle plate 31 of the ink jet print head 1 several times after the print head 1 is moved to the non-printing area.

A third conventional example of a conventional ink jet print head 1 also described in Japanese Patent Application Kokai No. HEI2-150355 is shown in cross section in FIG. 6. Components similar to those described in the second conventional example will be accompanied by the same numbering to omit superfluous explanation. The ink jet print head 1 of this example is substantially the same as that of the above-described second example except that the manifold 22 is not formed in the cover plate 3. In this example, the piezoelectric ceramic plate 2 is formed with through-holes 23, and a base plate 60 formed with a manifold 22 is provided between the piezoelectric ceramic plate 2 and the substrate 41. To produce this ink jet print head, grooves 8, which form the ink channels 12, and shallow channels 16 are formed in the piezoelectric ceramic plate 2. A through hole 23 is then formed in the bottom of each groove 8. A manifold 22 is formed in the base plate 60 running perpendicular to the grooves 8. An ink introduction port 21 is formed in the cover plate 3. The cover plate 3 is adhered to the grooved side of the piezoelectric ceramic plate 2. Then, the side of the base plate 60 with the manifold 22 formed therein is adhered to the side of the piezoelectric ceramic plate 2 with the through holes 23 formed therein. At this time, because the through holes 23 confront the manifold 22, the manifold 22 is brought into communication with the plurality of grooves 8. Further, the nozzle plate 31 is adhered to the piezoelectric ceramic plate 2, the cover plate 3, and the base plate 60. The substrate 41 is adhered to the side of the base plate 60 opposite that with the manifold 22 formed therein.

A fourth conventional example of a conventional ink jet print head 1 as described in European Patent Application Publication No. 0 516 284 A2 will be described below with reference to FIG. 7. Components similar to those described in the second conventional example will be accompanied by the same numbering to omit superfluous explanation. The ink jet print head 1 of this example is substantially the same as that of the second example except that the nozzle plate 31 is omitted from the ink jet print head 1. That is, the ink jet print head 1 of this example is constructed from a piezoelectric ceramic plate 2; the cover plate 3; and the substrate 41. The piezoelectric ceramic plate 2 of this example is formed with not only the grooves 8 and the shallow grooves 16 but also small grooves 7. The small grooves 8 have cross-sectional area smaller than the cross-sectional area of the grooves 8. The small grooves 7 are cut into the piezoelectric ceramic plate 2 in fluid communication with the grooves 8.

An epoxy-type adhesive, for example, is used to bond the surface of the cover plate 3 to the surface of the piezoelectric ceramic plate 2 containing the grooves 8. As a result, the cover plate 3 covers the grooves 8 thereby forming in the ink jet print head 1 a plurality of ink channels having a mutual interval in the horizontal direction. Also the small grooves 7 are covered, forming a plurality of nozzles with positions corresponding precisely to the positions of the channels.

It is noted that similarly as in the second conventional example, the substrate 41 is adhered to the piezoelectric ceramic plate 2 in the same manner as in FIG. 2.

Conventional ink jet print heads, however, have various problems. For example, there has been a problem with the piezoelectric ceramic element 76 of the first conventional example of FIG. 1 in that, as shown in FIG. 8, the cutting and grinding processes for forming the piezoelectric ceramic element 76 generate microcracks 91 in the cut and ground surfaces 90 of the piezoelectric ceramic element 76. Because the piezoelectric ceramic element 76 deforms upon application of a voltage, the microcracks can progress into a break.

Also, piezoelectric ceramic particles 94 can drop out of the cut and ground surface 90 in the piezoelectric ceramic element 76, as indicated by the broken line in FIG. 8, increasing the roughness of the surface 90. This prevents forming a continuous metal electrode 77 or forming the metal electrode to a uniform thickness. When the metal electrode 77 is formed in this way, the amount that a piezoelectric ceramic element 76 deforms by application of a voltage varies with the piezoelectric ceramic element 76 so that the volume of ink droplets ejected from each nozzle 82 also varies. This degrades quality of printed characters.

Because in the second through fourth conventional example the sidewall 11 which deforms to eject ink is formed in the same way as in the first conventional example, that is, by cutting and the like of the piezoelectric ceramic element, as shown in FIG. 8, microcracks 91 are generated in the side surface of the sidewall 11 (the cut surface 90). Because application of a voltage deforms the sidewall surface 11 by piezoelectric thickness shear effect, when microcracks are generated, there is a great possibility that the deformation will promote the cracks into a break.

For the same reason as described above in the first conventional example, a rough sidewall 11 surface (which is the cut surface 90) prevents forming a continuous or uniformly thick metal electrode 13. Such variation causes each sidewall 11 to deform to a different extent so that ink droplets ejected from each nozzle 32 contain different volumes. Quality of printed characters suffers accordingly.

Especially, in the ink jet print head of the fourth conventional example as shown in FIG. 7, the small grooves 7, which form the nozzles in the piezoelectric ceramic plate 2', are formed also by cutting processes. For this reason, as shown in FIG. 8, microcracks are generated in the bottom and side surfaces (the cut surfaces) of the small grooves 7. Piezoelectric ceramic particles 94 can fall from the bottom walls and sidewalls 90 of the small grooves, as indicated by the broken line in FIG. 8. This worsens the roughness of the surfaces. As a result, when ejecting ink droplets, the flow of ink passing through the nozzle is disrupted, affecting the direction of the ink droplet. Ink spray is easily generated in this situation, degrading quality of printed characters.

There has been another problem in ink jet print heads constructed as per the second and third conventional examples of FIGS. 2 and 6. Because the nozzle plate 31 formed with nozzles 32 is adhered to the cover plate 3 and the piezoelectric ceramic plate 2, the relative positions of the nozzles to the channels 8 is determined by where the nozzles 32 are formed in the nozzle plate 32 and where the nozzle plate is adhered to the tip of the piezoelectric ceramic plate 2 and the cover plate 3. Therefore, the nozzles 32 are sometimes imprecisely aligned with the ink channels 8. Also, when the nozzle plate 31 is adhered, excess adhesive runs into the inner surface of the nozzles 32, disrupting the linear ejection of ink or clogging the nozzles.

There has been a further problem in the ink jet print head of the second conventional example shown in FIG. 2 in that because both the ink introduction port 21, for introducing ink from an ink supply source (ink reservoir 61), and the manifold 22, which supplies the introduced ink to the plurality of ink channels, are formed in the cover plate 3, the shape of, and controlling cutting processes for forming, the cover plate 3 becomes complex. Because the direction of the cutting operation is changed to form the grooves 8 and the shallow grooves 16 in the piezoelectric ceramic plate 2, the process control becomes complex. Therefore, production of the cover plate 3 and the piezoelectric ceramic plate 2 is time consuming and not well suited for mass production.

In a conventional ink jet print head of the third example shown in FIG. 6, the ink introduction port 21 is formed in the flat cover plate 3. Grooves 8, shallow grooves 16, and the through holes 23 are formed in the piezoelectric ceramic plate 2. The manifold 22 is formed in the base plate 60. For this reason, the form of the cover plate 3 becomes simpler and the speed at which the cover plate 3 can be formed increases. However, because the through hole 23 is formed in the bottom of the groove 8 of the piezoelectric ceramic plate 2, the shape of the piezoelectric ceramic plate 2 becomes more complex than that of the second conventional example, and cutting processes become time consuming. Also, because the base plate 60 is required for forming the manifold 22, the number of components increases and production costs increase. Therefore, the device is poorly suited to mass production.

SUMMARY OF THE INVENTION

In order to solve the above-described various problems, the first objective of the present invention is to provide an ink jet print head and a method of producing the same wherein microcracks are not generated in the piezoelectric ceramic element.

A second objective is to provide an ink jet print head and a method of producing the same wherein a metal electrode is uniformly formed.

A third objective is to provide an ink jet print head, and a method of producing the same, wherein the device can print with good quality because the nozzles are well shaped with smooth inner surfaces and are formed at precise positions.

A fourth objective is to provide an ink jet print head well suited for mass production.

In order to attain the above-described objectives, the present invention provides an ink ejection device for ejecting ink, comprising: a piezoelectric ceramic plate for defining an ink channel for containing ink, the piezoelectric ceramic plate deforming by application of an electric voltage thereto so as to change the volume in the ink channel and eject ink from the ink channel, the piezoelectric ceramic plate being formed by injection molding so that the piezoelectric ceramic plate having one surface with a surface roughness Rz defined in Japanese Industrial Standard JIS B 0601 of 1 μm or less; and a metal electrode provided on the surface of the piezoelectric ceramic plate for applying the electric voltage to the piezoelectric ceramic plate.

According to another aspect, the present invention provides a method of producing an ink ejection device for ejecting ink, the ink ejection device including a drive wall for defining an ink channel for containing ink and for deforming upon application of an electric voltage thereto so as to change the volume in the ink channel and eject ink from the ink channel and a metal electrode provided on a surface of the drive wall for applying the electric voltage to the drive wall, the method comprising the steps of: injection molding a drive wall from piezoelectric ceramic material so that the drive wall may have one surface with a surface roughness Rz defined in Japanese Industrial Standard JIS B 0601 of 1 μm or less, the drive wall defining an ink channel for containing ink and being for deforming upon application of an electric voltage thereto so as to change the volume in the ink channel and eject ink from the ink channel; and providing a metal electrode on the surface of the piezoelectric ceramic plate, the metal electrode being for applying the electric voltage to the piezoelectric ceramic plate.

According to a further aspect, the present invention provides an ink ejection device for ejecting ink, comprising: a piezoelectric ceramic element for defining an ink channel for containing ink and for deforming by application of an electric voltage thereto so as to change the volume in the ink channel and eject ink from the ink channel; and a nozzle wall for defining a nozzle in communication with the ink channel for ejecting an ink droplet from the ink channel by deformation of the piezoelectric element, wherein the piezoelectric ceramic element and the nozzle wall are integrally formed by injection molding from piezoelectric ceramic material. The ink ejection device may further comprise a metal electrode provided on a surface of the piezoelectric ceramic element for applying the electric voltage to the piezoelectric ceramic element.

According to another aspect, the present invention provides an ink ejection device for ejecting ink, comprising: a piezoelectric ceramic element having a plurality of drive walls for defining a plurality of ink channels for containing ink, each of the drive walls deforming by application of an electric voltage thereto so as to change the volume in the corresponding ink channel and eject ink therefrom; an ink introduction port wall for defining an ink introduction port for introducing ink toward the plurality of ink channels; and an ink manifold wall for defining an ink manifold in communication with the ink introduction port for supplying the introduced ink to the plurality of ink channels, wherein the piezoelectric ceramic element and at least one of the ink introduction port wall and the ink manifold wall are integrally formed by injection molding from piezoelectric ceramic material. The ink ejection device may further comprise a plurality of metal electrodes respectively provided on the drive walls for applying the electric voltage to the drive walls.

BRIEF DESCRIPTION OF THE DRAWINGS

The above and other objects, features and advantages of the invention will become more apparent from reading the following description of the preferred embodiment taken in connection with the accompanying drawings in which.

DETAILED DESCRIPTION OF THE PREFERRED EMBODIMENTS

Figure 1:
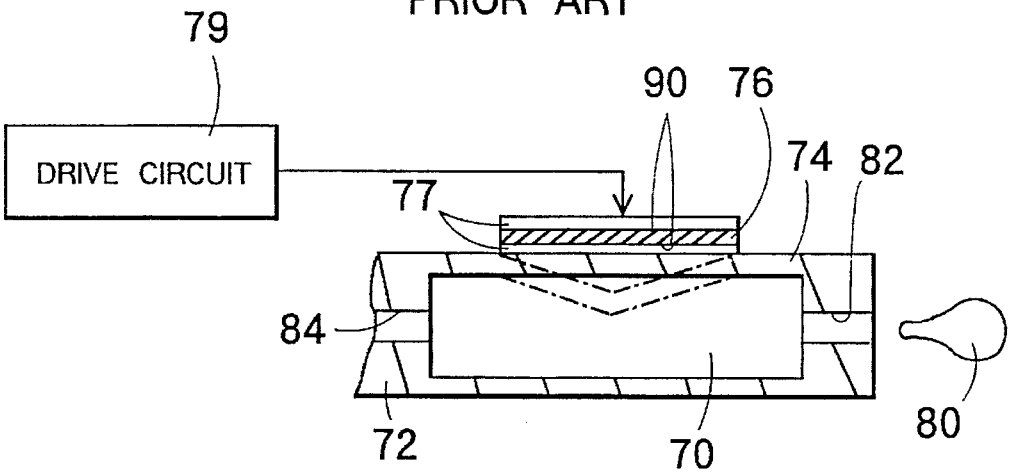
FIG.1 PRIOR ART
FIG. 1 is a side sectional view of a first example of a conventional ink jet print head.

An ink jet print head and method of producing the same according to preferred embodiments of the present invention will be described while referring to the accompanying drawings wherein like parts and components are designated by the same reference numerals to avoid duplicating description.

Figure 2:
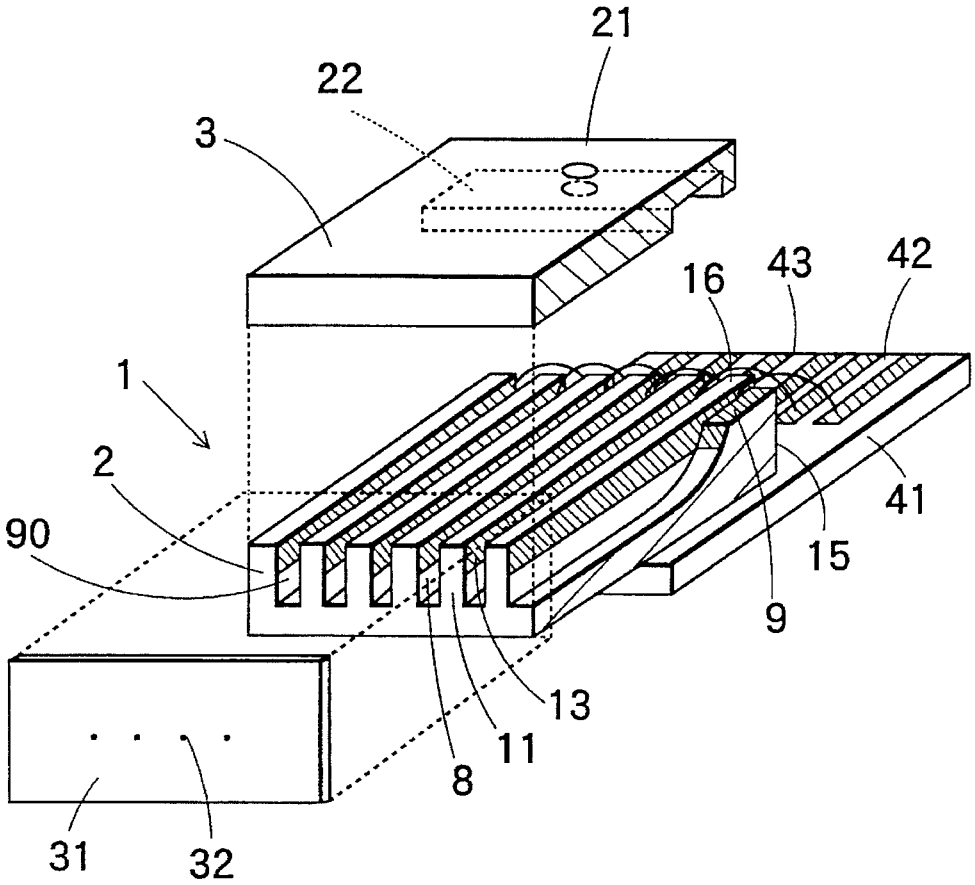
FIG.2 PRIOR ART
FIG. 2 is a perspective view of a second example of a conventional ink jet print head.

A first preferred embodiment according to the present invention will be described hereinafter. The first embodiment provides a new method of producing a piezoelectric ceramic plate 2 having the same structure as that of the conventional piezoelectric ceramic plate 2 as shown in FIG. 2.

According to the method of this embodiment, first, a calcined piezoelectric ceramic powder and a binder such as a thermoplastic resin, a wax or a plastic are kneaded together. Polyethylene, polypropylene, polystyrene, ethylene-vinyl acetate copolymer, polyacrylic acid, polyacrylic ester, polymethacrylic acid, polymethacrylic ester, and the like can be used for the thermoplastic resin. A natural wax, such as beeswax, carnauba wax, Japan wax, paraffin wax, or microcrystalline wax, or a synthetic wax, such as polyethylene glycol, a montan wax derivative, a paraffin wax derivative, or a microcrystalline wax derivative can be used for the wax. Diethyl phthalate, dibutyl phthalate, dioctyl phthalate, and fatty acid ester can be used as the plastic binder. A lubricant, such as stearic acid, can also be added to the binder. The ratio of the volume of piezoelectric ceramic powder to the volume of the binder is usually between 50:50 and 60:40.

In an illustrative example, 90% by weight of the piezoelectric ceramic powder of lead zirconium titanate which has been calcined at temperature of 850° C., 5% by weight of the thermoplastic resin of polymethacrylic ester, 2% each by weight of the waxes of paraffin wax and microcrystalline wax, and 1% by weight of the plastic of dioctyl phthalate are weighed and then kneaded for two hours in a pressure kneader.

There are no particular restrictions as to the kneading method. Kneading can be performed using another device such as a Banbury mixer.

After kneading, the kneaded material is pelletized by a pelletizer. The pellets become the material for injection molding.

The kneaded material need not necessarily be pelletized in a pelletizer. Granulating the kneaded material in a grinding machine is also acceptable.

The injection molding material is put into an injection molding machine 100 and injection molded into a piezoelectric ceramic molded product under 700 kgf/cm$^2$ injection pressure. A metal mold used in the injection molding machine has such a form that may be transcribed to the injection molding material and may provide the piezoelectric ceramic molded product which has formed therein the grooves 8, the shallow grooves 16 and the sidewalls 11 as shown in FIG. 2. For example, the grooves 8 are 100 μm wide and 600 μm deep.

The injection molding machine can be a standard injection molding machine for injection molding resins or an injection molding machine with improved abrasion resistance required for injection molding ceramics and metals.

The piezoelectric ceramic molded product is then placed in a degreasing furnace 102 where degreasing processes are performed to remove organic materials, such as thermoplastic resins, from the piezoelectric ceramic molded product. During this time, argon, nitrogen, hydrogen, oxygen, air, or a mixture of two or more of these gases are introduced to the degreasing furnace. The degreasing oven can be pressurized, evacuated, or maintained at normal pressure.

In this present example, temperature in the degreasing furnace is increased from room temperature to 120° C. at a rate of 50° C./hour, from 120° to 160° C. at a rate of 10° C./hour, from 160° to 200° C. at a rate of 4° C./hour, from 200° to 350° C. at a rate of 5° C./hour, from 350° to 450° C. at a rate of 10° C./hour, and from 450° to 500° C. at a rate of 50° C./hour.

Temperature does not necessarily need to be raised at the rates described above. Raising the temperature from room temperature to the range of 500° to 600° C. at a rate of anywhere between about 2 to 100° C./hour is satisfactory.

After the piezoelectric ceramic is degreased, the furnace is cooled. At this point, compressed air from an air compressor 104 is introduced into the degreasing furnace through a gas introduction port. The compressed air, along with the thermoplastic resin and other organic materials removed from the piezoelectric ceramic molded product, is then evacuated from a gas discharge port in the degreasing furnace.

The degreased piezoelectric ceramic, with thermoplastic resins and other organic materials removed, is placed in an atmospheric sintering furnace and sintered.

In the present example, the temperature in the atmospheric sintering furnace 106 is raised from room temperature to 1,200° C. at a rate of 150° C./hour. After the temperature is maintained at 1,200° C. for two hours, the temperature is lowered to 700° C. at a rate of 300°/hour. Afterward, the furnace is allowed to cool, thus completing formation of the piezoelectric ceramic plate 2 having the same structure as shown in FIG. 2. The sintering process contracts the grooves 8 in the piezoelectric ceramic sinter to 85 μm wide and 500 μm deep.

The temperature in the atmospheric sintering furnace need not necessarily be raised in the manner described above. Raising the temperature from room temperature to the range of 900° to 1,400° C. and maintaining the maximum temperature from anywhere between 0 to 2 hours is satisfactory.

In order to produce an ink jet print head 1 having the same structure as shown in FIG. 2, the piezoelectric ceramic plate 2 formed in the manner described above is then polarized in the direction indicated by the arrow 5. A metal electrode 13 is then formed by, for example, sputtering using a sputtering device 108 along the upper half of both side surfaces of each groove 8. A metal electrode 9 is formed by, for example, sputtering on the side and bottom surfaces of the inner surface of each shallow groove 16. Thus the metal electrode 9 formed in each shallow groove 16 connect the two metal electrodes 13 formed to side surfaces of each groove 8 to each other.

An epoxy-type adhesive 4, for example, is used to bond the surface of the cover plate 3, made from, in this example, lead zirconium titanate, to the surface of the piezoelectric ceramic plate 2 containing the grooves 8. As shown in FIG. 2, the cover plate 3 covers the grooves 8 thereby forming in the ink jet print head 1 a plurality of ink channels 12 having a mutual interval in the horizontal direction.

A substrate 41 is then adhered to the piezoelectric ceramic plate 2. A conductor layer pattern 42 is formed to the substrate 41. Conductor wires 43 are connected by wire bonding between the conductor layer pattern 42 and the metal electrodes 9 in shallow grooves 16. Thus, an ink jet print head having the same structure as shown in FIG. 2 is obtained.

Figure 3A:
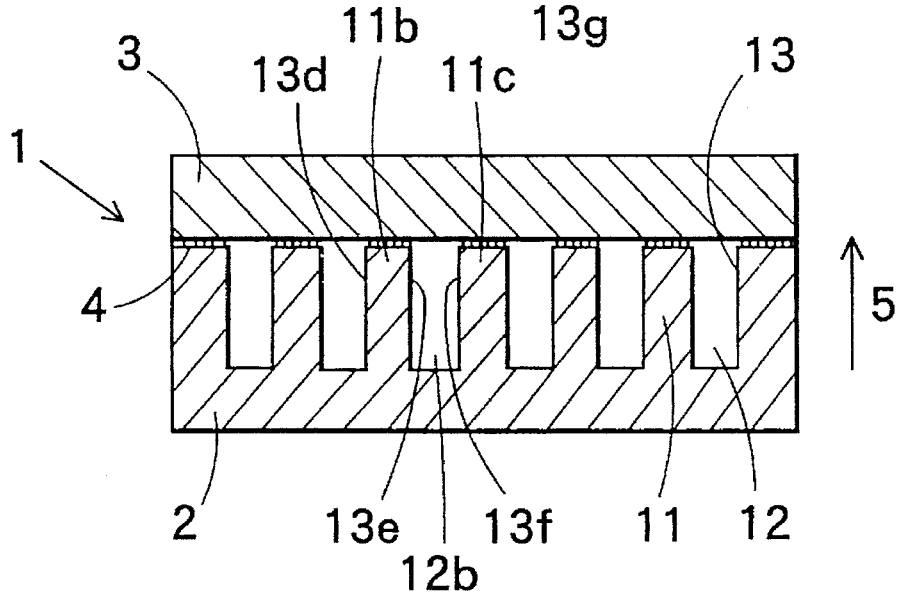
FIG.3a PRIOR ART
FIG. 3*a* is a sectional view of the ink jet print head of FIG. 2.
Figure 3B:
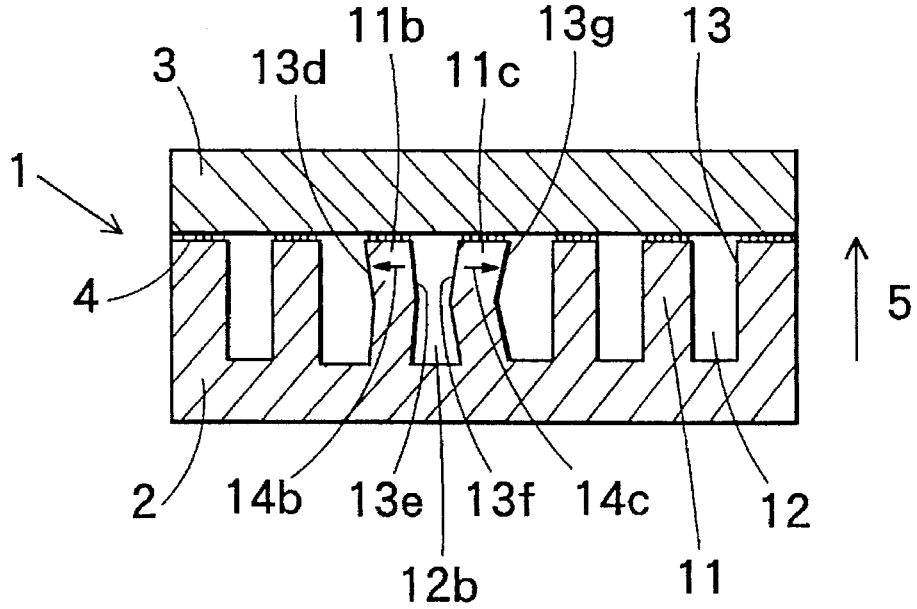
FIG.3b PRIOR ART
FIG. 3*b* is a sectional view illustrating the operation of the ink jet print head of FIG. 2.
Figure 4:
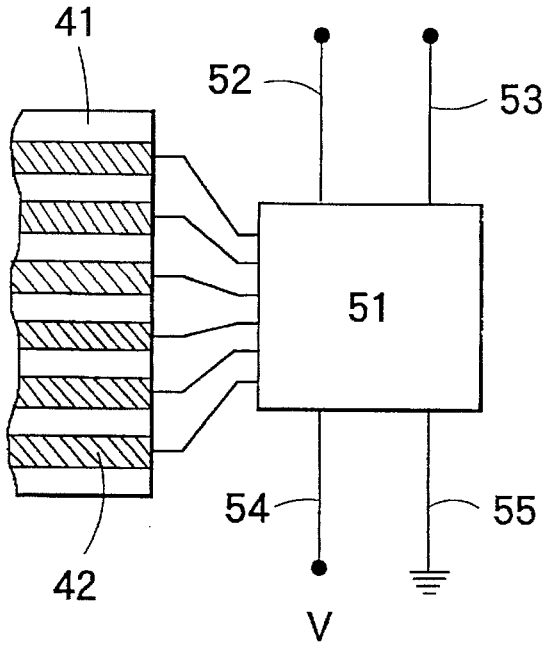
FIG.4 PRIOR ART
FIG. 4 illustrates a control portion for operating the ink jet print head of FIG. 2.
Figure 5:
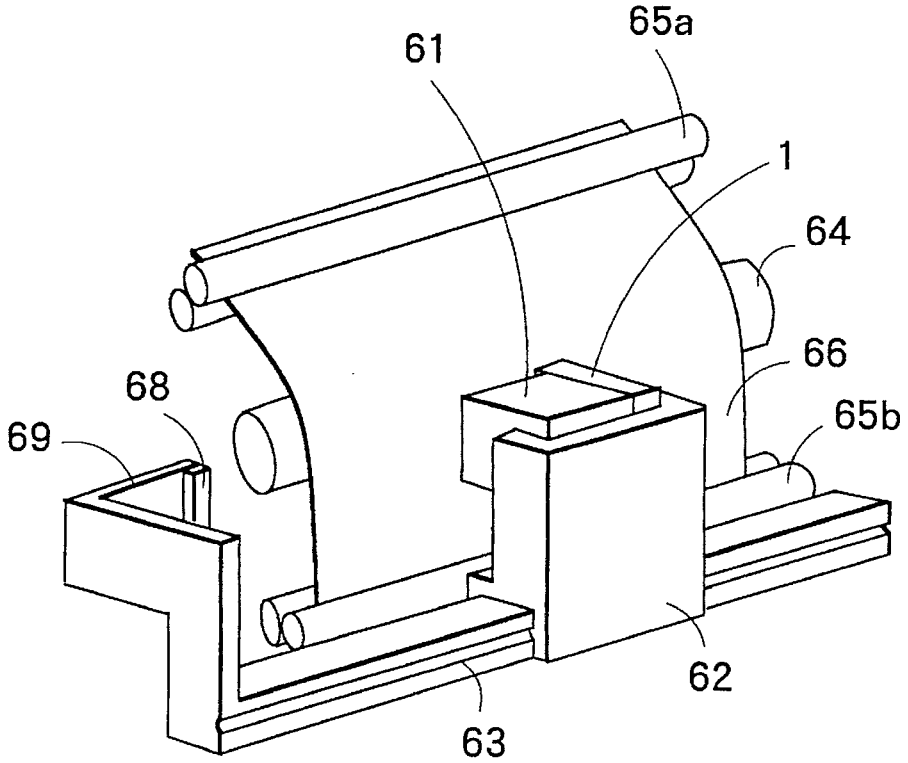
FIG.5 PRIOR ART
FIG. 5 is a perspective view of an ink jet printer employed with the ink jet print head of FIG. 2.
Figure 6:
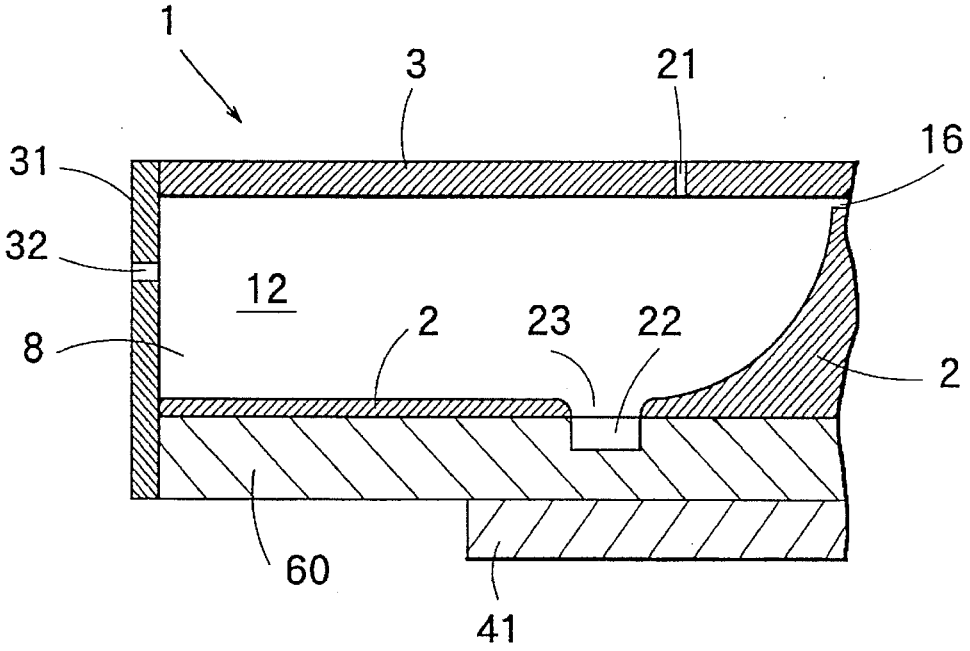
FIG.6 PRIOR ART
FIG. 6 is a side sectional view of a third example of a conventional ink jet print head.
Figure 7:
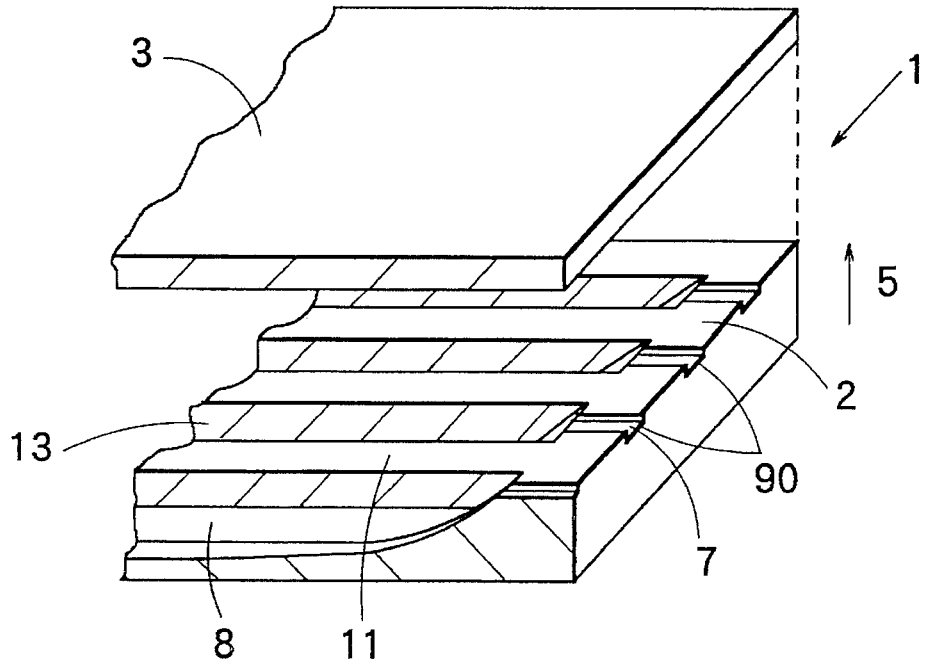
FIG.7 PRIOR ART
FIG. 7 is a perspective view of a fourth example of a conventional ink jet print head.

The control portion for driving the thus obtained ink jet print head 1 may have the same structure as shown in FIG. 4. The ink jet print head can operate in the same way as shown in FIGS. 3*a* and 3*b*. The ink jet print head can be applied to the ink jet printer as shown in FIG. 5.

EXPERIMENT

The surface roughness Rz (JIS B 0601) of the sidewall 11 of the piezoelectric ceramic plate 2, which is the piezoelectric ceramic sinter formed by the above-described method of the present embodiment, was measured using a surface roughness tester. The surface roughness Rz is defined in Japanese Industrial Standard "JIS B 0601" as the maximum difference in height between pits and projections on an uneven surface. Destructive testing, where a load was applied normal to the wall surface at the upper portion of the sidewall 11 near the adhesive layer 4, was performed using a special apparatus. The breaking stress generated near the border of the bottom portion of the groove 8 and the sidewall 11 was measured. The measured value is considered the strength of the sidewall 11.

For purposes of comparison, the surface roughness Rz (JIS B 0601) and the strength of the sidewall 11 of a piezoelectric ceramic plate 2 formed by conventional methods were also measured.

In Table 1, the surface roughness Rz (JIS B 0601) and strength of sidewalls 11 in a piezoelectric ceramic plate 2 formed according to the method of the first preferred embodiment are compared to the surface roughness Rz (JIS B 0601) and strength of sidewalls 11 in a piezoelectric ceramic plate 2 formed according to conventional methods.

TABLE 1

| | First Preferred Embodiment | Conventional |
|---|---|---|
| Roughness Rz (μm) of the Sidewall Surface | 0.8 to 1.0 | 2.0 to 4.0 |
| Strength of the Sidewall ($kgf/mm^2$) | 35 to 40 | 10 to 30 |

As can be clearly seen in Table 1, the surface roughness Rz and the strength of the sidewall 11 of the piezoelectric ceramic plate 2 formed according to the method of the first preferred embodiment are superior to those of sidewalls 11 in the conventional piezoelectric ceramic plate 2.

Figure 8:
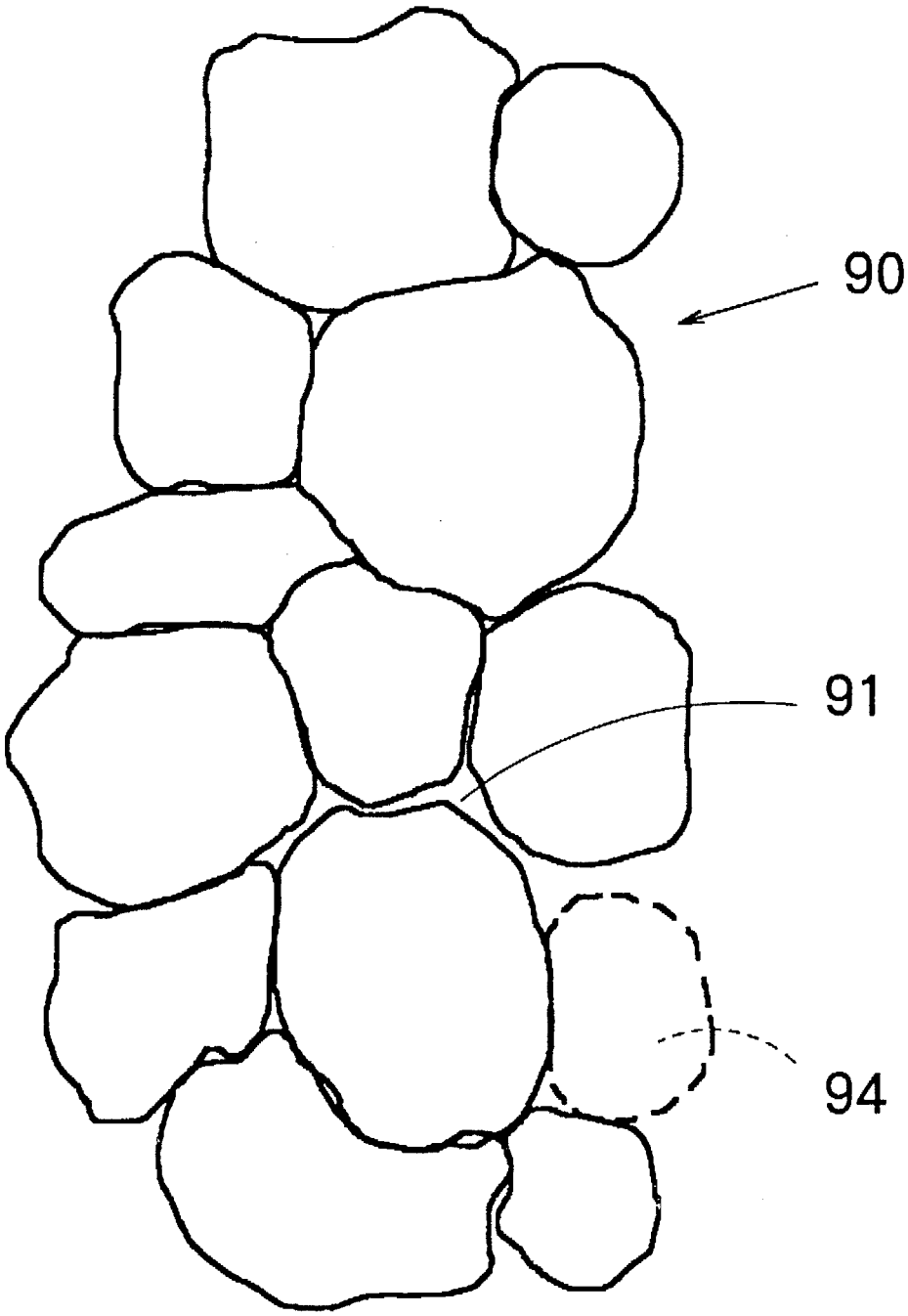
FIG.8 PRIOR ART
FIG. 8 illustrates a surface of a sidewall formed in a piezoelectric ceramic plate of the first through fourth examples of the conventional ink jet print head.
Figure 9:
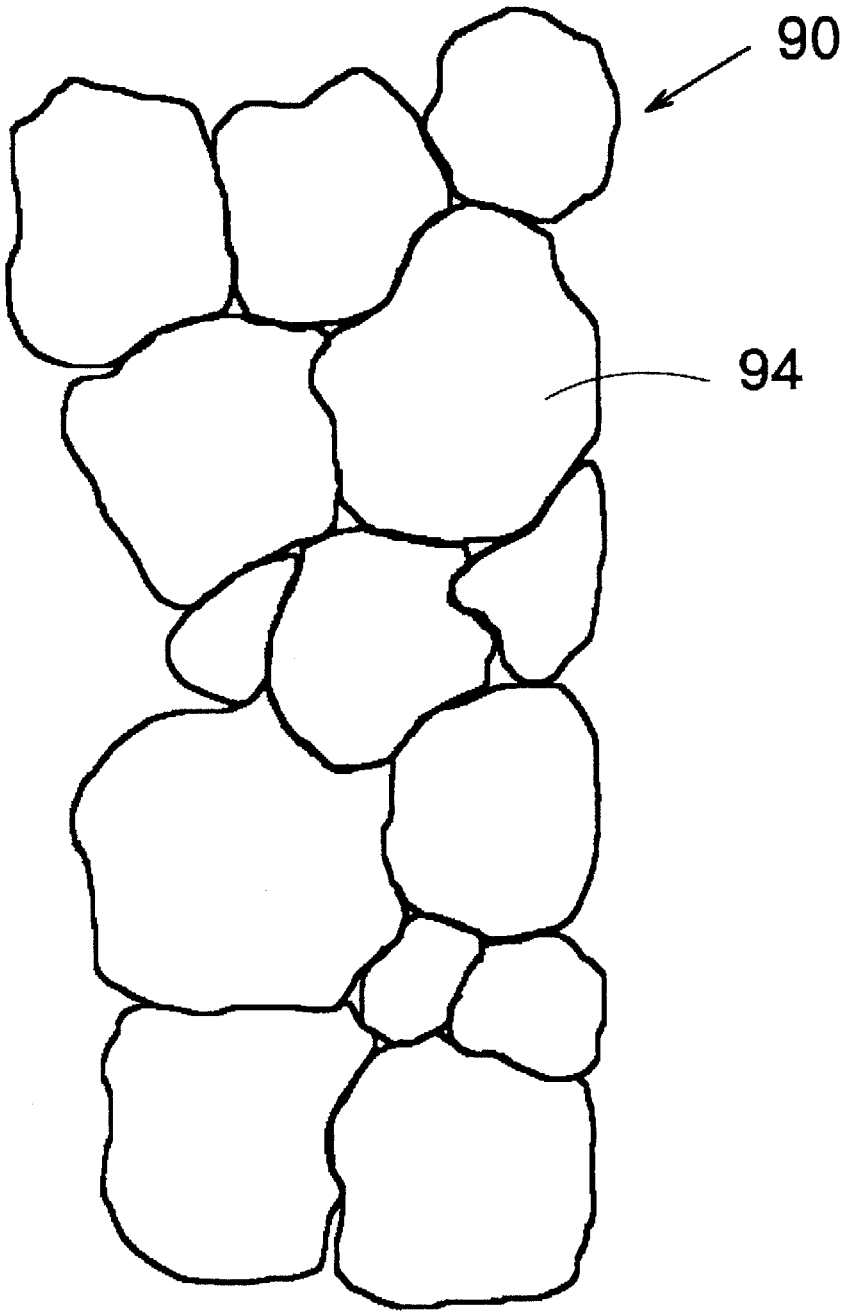
FIG. 9 illustrates a surface of a sidewall formed in a piezoelectric ceramic plate for an ink jet print head produced according to an injection molding method of a first preferred embodiment of the present invention.

As shown in FIG. 9, no piezoelectric ceramic particles 94 were missing from the surface 90 of the sidewall 11. Because all particles 94 were present on the surface, the surface roughness Rz was 1 μm or less. Because no microcracks 91 (see FIG. 8) were generated in the sidewall 11, the sidewall 11 had a strength of 35 kgf/mm$^2$ or more. Furthermore, such dimensions as the width, height, and pitch of each sidewall 11 were highly precise.

Even if materials other than the piezoelectric ceramic powder, thermoplastic resin, wax, or plastic material described above in the first preferred embodiment are used, the surface roughness Rz of the sidewall 11 of the piezoelectric ceramic plate 2 becomes 1 μm or lower and its strength becomes 35 kgf/mm$^2$ or greater.

A metal electrode 13 was formed to the sidewall 11 of the piezoelectric ceramic plate 2 formed according to the method of the first preferred embodiment. Because the surface roughness Rz of the sidewall 11 is 1 μm or less, the metal electrode 13 was uniformly formed.

As described above, according to the first preferred embodiment of the present invention, because microcracks 91 (refer to FIG. 8) are not generated in the piezoelectric ceramic plate 2 formed by injection molding, deformation caused by the piezoelectric thickness shear effect does not crack the sidewall 11. Also, the strength of the sidewall 11 is high. Because no spaces appear in the surface 90 of the sidewall 11 from missing particles, the surface roughness Rz is 1 μm or less so the metal electrode 13 can be formed uniformly. For this reason, the amount of positional change of each sidewall 11 is substantially the same so the volume of ink droplets ejected from each nozzle 32 is substantially the same. This improves the quality of printed characters.

Because the metal electrode 13 is uniform, and moreover, because the sidewall 11 is strong, a high drive current can be applied and the position of the sidewall 11 can be greatly changed. For this reason, ejection of ink droplets becomes good.

A second preferred embodiment of the present invention will be described while referring to FIG. 10. As can be seen in the figure, a piezoelectric ceramic plate 2 of the second preferred embodiment is substantially the same as that of the first preferred embodiment, except that the nozzles 32 are integrally formed during the injection molding operation. That is, the piezoelectric ceramic molded product produced by the injection molding operation has integrally formed therein the grooves 8, the shallow grooves 16, the sidewalls 11, and the nozzles 32. The method of producing the piezoelectric ceramic plate 2 of this embodiment is therefore substantially the same as that of the first embodiment, except that the metal mold used in this embodiment has such a form that may be transcribed to the injection molding material and may produce the piezoelectric ceramic molded product that has the grooves 8, the shallow grooves 16, the sidewalls 11, and the nozzles 32. Thus produced piezoelectric ceramic molded product has the nozzles with a diameter of 50 μm. The sintering process contracts the diameter of the nozzles 32 to 43 μm.

Figure 10:
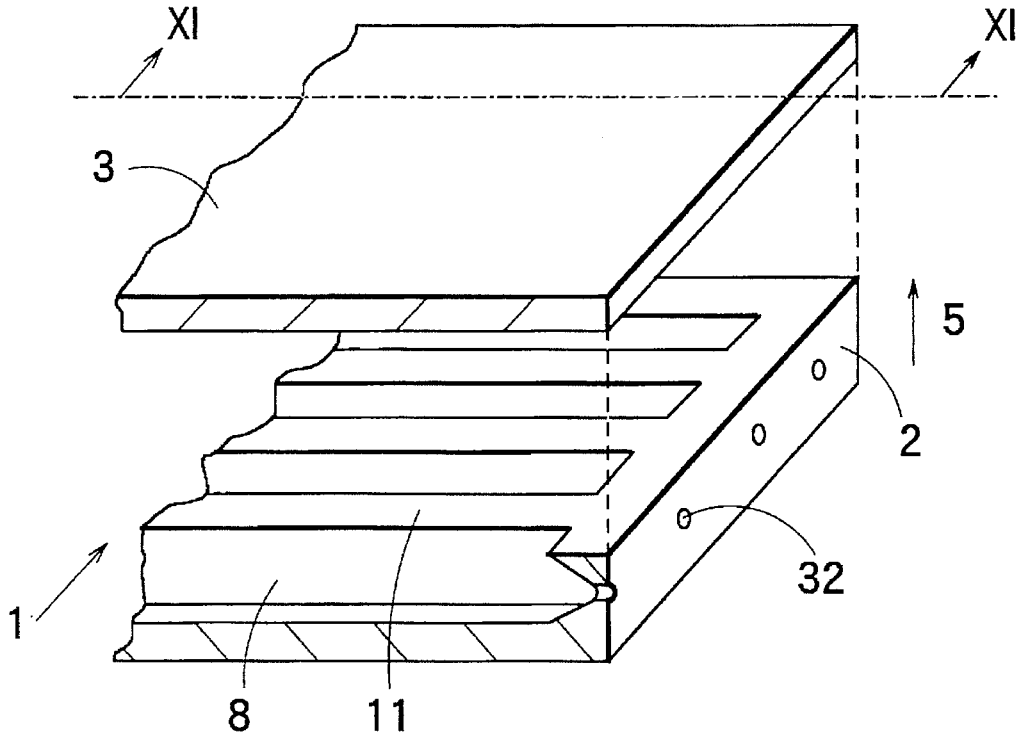
FIG. 10 is a perspective view of a piezoelectric ceramic plate for an ink jet print head according to a second preferred embodiment of the present invention.

In order to produce an ink jet print head 1, the piezoelectric ceramic plate 2 of FIG. 10 is formed with the electrodes 13 and 9 and is adhered to the cover plate 3 and the substrate 41 in the same way as described in the first embodiment and as shown in FIG. 2.

Also in this second embodiment, because the piezoelectric ceramic plate 2 is formed by injection molding, microcracks 91 (refer to FIG. 8) are not generated in the surfaces 90 of the side walls 11. Because no spaces appear in the surfaces 90 from missing particles, the surface roughness Rz becomes 1 μm or less so the metal electrodes 13 can be formed uniformly.

In the present embodiment, because the grooves 8 and the nozzles 32 are integrally formed by injection molding, no adhesive flows into the nozzles 32, and clogging of the nozzles is prevented. Moreover, the relative positions of the grooves 8 and the nozzles 32 are already precise so do not need to be aligned. Further, no microcracks 91 (refer to FIG. 8) are generated at the inner surface of the grooves 8 or the nozzles 32 and surface roughness of the inner surface is improved. The nozzles 32 have a good shape. For this reason, when ink droplets are ejected, the ink flows smoothly through the nozzles. Ejection of ink droplets becomes good and generation of ink spray is prevented. Therefore, quality of printed characters becomes good.

Figure 11:
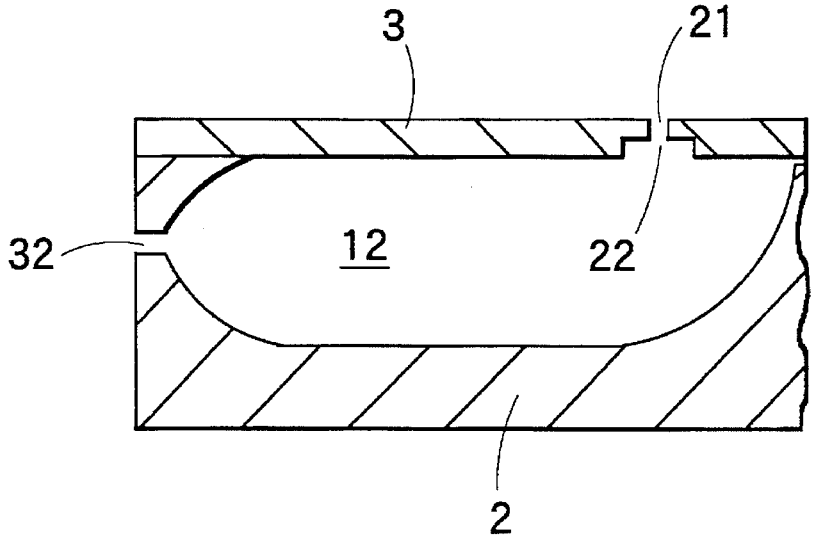
FIG. 11 illustrates one example of a sectional side view taken along a line XI—XI of the piezoelectric ceramic plate of FIG. 10.

Further, as shown in FIG. 11, because the area near the grooves 8 and the nozzles 32 are in communication by a curved surface, flow of ink caused when ink is ejected is uniform and smooth. For this reason, air that enters via the nozzle 32 is discharged with ejection of an ink droplet. Therefore, air does not enter the ink channel and impede ejection of ink droplets and ejection of ink droplets becomes good.

Because the nozzles 32 are formed by injection molding, the nozzles 32 can be easily formed at any position with respect to the grooves 8.

Figure 12:
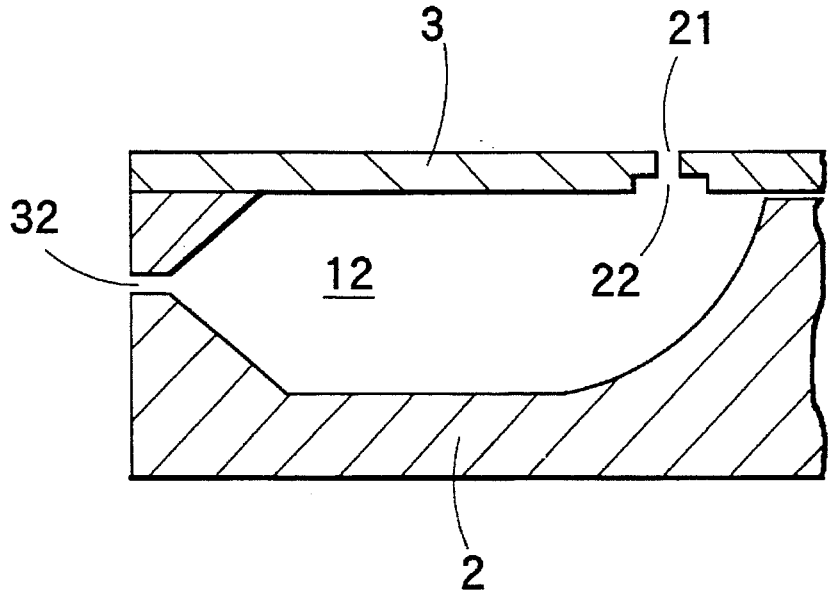
FIG. 12 illustrates another example of a sectional side view taken along a line XI—XI of the piezoelectric ceramic plate of FIG. 10.

Although this second preferred embodiment describes the area near the grooves 8 and the nozzles 30 as connected by a curved surface as shown in FIG. 11, the same effects can be obtained by connecting the area near the grooves 8 and the nozzles 32 with an inclined surface as shown in FIG. 12.

Figure 13:
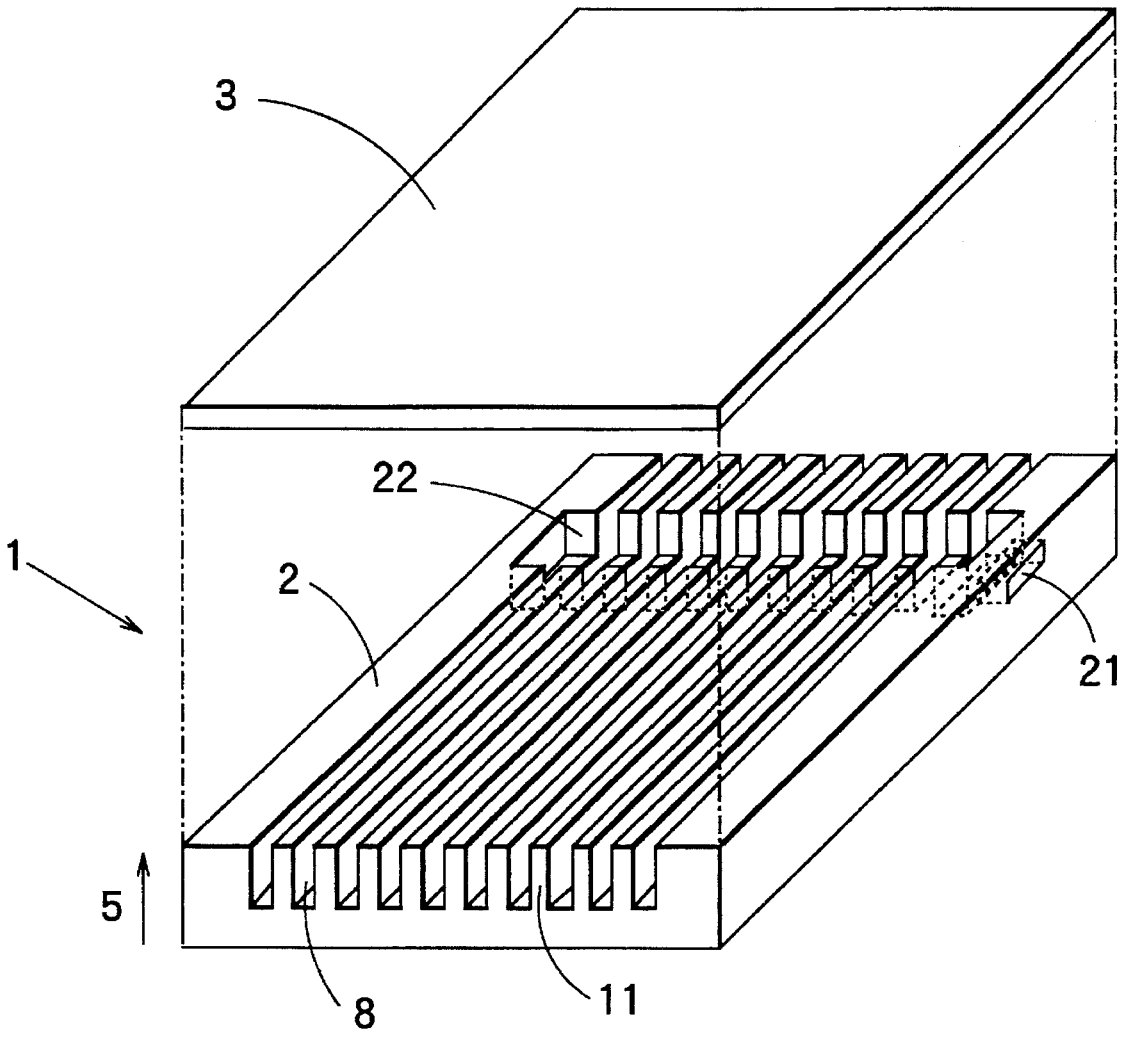
FIG. 13 is a perspective view of a piezoelectric ceramic plate for an ink jet print head according to a third preferred embodiment of the present invention.

A piezoelectric ceramic plate 2 for an ink jet print head according to a third preferred embodiment, as shown in FIG. 13, includes grooves 8, shallow grooves 16, sidewalls 11, ink introduction port 21, and manifold 22 integrally formed using the same processes as described in the first preferred embodiment. More specifically, in this embodiment, the piezoelectric ceramic molded product produced by the injection molding operation has integrally formed therein the grooves 8, the shallow grooves 16, the sidewalls 11, the ink introduction port 21, and the manifold 22. The method of producing the piezoelectric ceramic plate 2 of this embodiment is therefore substantially the same as that of the first embodiment, except that the metal mold used in this embodiment has such a form that may be transcribed to the injection molding material and may produce the piezoelectric ceramic molded product that has the grooves 8, the shallow grooves 16, the sidewalls 11, the ink introduction port 21, and the manifold 22. The ink introduction port 21 is formed on the side surface of the piezoelectric ceramic plate 2. The manifold 22 is in communication with the ink introduction port 21. The depth of the manifold 22 is about ⅓ the height of the side wall 11 as measured from the tip surface of the sidewall 11.

In order to produce an ink jet print head 1, the metal electrodes 9 and 13 are formed, and the cover plate 3 and the substrate 41 are adhered, in the same way as described in the first preferred embodiment.

Also in this third embodiment, because the piezoelectric ceramic plate 2 is formed by injection molding, microcracks 91 (refer to FIG. 8) are not generated in the surfaces 90 of the side walls 11. Because no spaces appear in the surfaces 90 from missing particles, the surface roughness Rz becomes 1 μm or less so the metal electrodes 13 can be formed uniformly.

In the present embodiment, the cover plate 3 can be formed flat, with cutting or other shaping processes unnecessary, because the piezoelectric ceramic plate 2 is integrally formed with the grooves 8, the shallow grooves 16, the side walls 11, the ink introduction portion 21, and the manifold 22 by injection molding. Therefore, the piezoelectric ceramic plate 2 and the cover plate 3 can be rapidly produced. Therefore, the ink jet print head 1 can be produced more rapidly and is suitable to mass production techniques. Because the piezoelectric ceramic plate 2 formed with the ink introduction port 21 and the manifold 22 is formed by injection molding, design work related to the manifold 22 and the ink introduction port 21, and the positions thereof, is relatively free.

Figure 14:
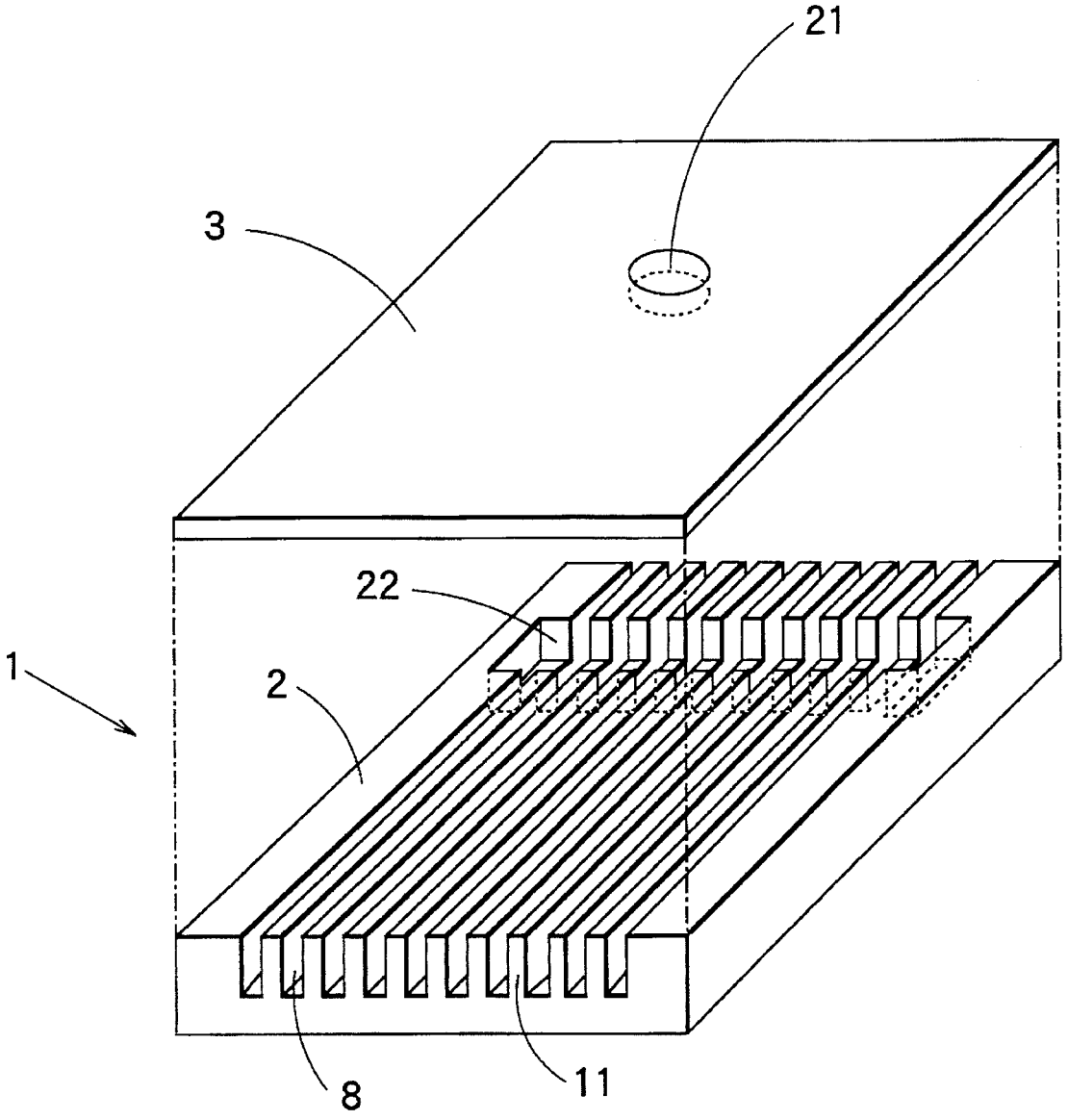
FIG. 14 is a perspective view of a piezoelectric ceramic plate for an ink jet print head according to a fourth preferred embodiment of the present invention.

As shown in FIG. 14, a piezoelectric ceramic plate 2 for an ink jet print head according to a fourth preferred embodiment is substantially the same as that described in the third preferred embodiment except that the ink introduction port 21 is formed in the cover plate 3 instead of in the piezoelectric ceramic plate 2. More specifically, in this embodiment, the piezoelectric ceramic molded product produced by the injection molding operation has integrally formed therein the grooves 8, the shallow grooves 16, the sidewalls 11, and the manifold 22. The method of producing the piezoelectric ceramic plate 2 of this embodiment is therefore substantially the same as that of the first embodiment, except that the metal mold used in this embodiment has such a form that may be transcribed to the injection molding material and may produce the piezoelectric ceramic molded product that has the grooves 8, the shallow grooves 16, the sidewalls 11, and the manifold 22.

In order to produce an ink jet print head, the metal electrodes 9 and 13 are formed in the same way as described in the first preferred embodiment. The cover plate 3, the nozzle plate 31, and the substrate 41 are adhered to the piezoelectric ceramic plate 2 in the same way as described in the first preferred embodiment.

Also in this third embodiment, because the piezoelectric ceramic plate 2 is formed by injection molding, microcracks 91 (refer to FIG. 8) are not generated in the surfaces 90 of the side walls 11. Because no spaces appear in the surfaces 90 from missing particles, the surface roughness Rz becomes 1 μm or less so the metal electrodes 13 can be formed uniformly.

In this embodiment, the ink introduction port 21 is formed in the cover plate 3, but because the manifold 22 is formed in the piezoelectric ceramic plate 2, the shape of the cover plate 3 is still simple, and its production is faster than production of conventional covers. Therefore, the ink jet print head 1 can be quickly produced and is well suited to mass production.

Figure 15:
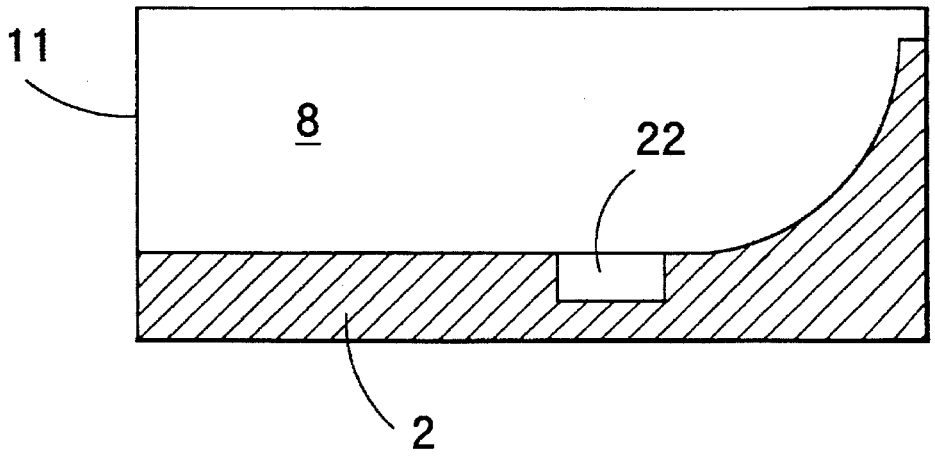
FIG. 15 is a side sectional view of a piezoelectric ceramic plate for an ink jet print head according to a fifth preferred embodiment of the present invention.

A fifth preferred embodiment according to the present invention will be explained. The piezoelectric ceramic plate 2 shown in FIG. 15 is formed in the same way as in the above-described fourth embodiment. That is, grooves 8, shallow grooves 16, sidewalls 11, and a manifold 22 are formed in this piezoelectric ceramic plate 2. Contrary to the fourth embodiment, the manifold 22 is provided below the side wall 11 in communication with the plurality of grooves 8. In addition, one end of the manifold 22 opens into the side of the piezoelectric ceramic plate 2. Ink is introduced from the open end (not shown) into the manifold 22. Accordingly, contrary to the fourth embodiment, the cover plate 3 is unnecessarily formed with the ink introducing port 21. In order to produce an ink jet print head, the electrodes 13 and 9 are formed, and the cover plate 3, the nozzle plate 31, and the substrate 41 are adhered similarly as described in the above-described embodiments.

Also in this fifth embodiment, because the piezoelectric ceramic plate 2 is formed by injection molding, microcracks 91 (refer to FIG. 8) are not generated in the surfaces 90 of the side walls 11. Because no spaces appear in the surfaces 90 from missing particles, the surface roughness Rz becomes 1 μm or less so the metal electrodes 13 can be formed uniformly.

In the present embodiment, the cover plate 3 can be formed flat, with cutting or other shaping processes unnecessary, because the piezoelectric ceramic plate 2 is integrally formed with the grooves, the side walls, and the manifold 22 by injection molding. Therefore, the piezoelectric ceramic plate 2 and the cover plate 3 can be rapidly produced. Therefore, the ink jet print head 1 can be produced more rapidly and is suitable to mass production techniques.

Figure 16:
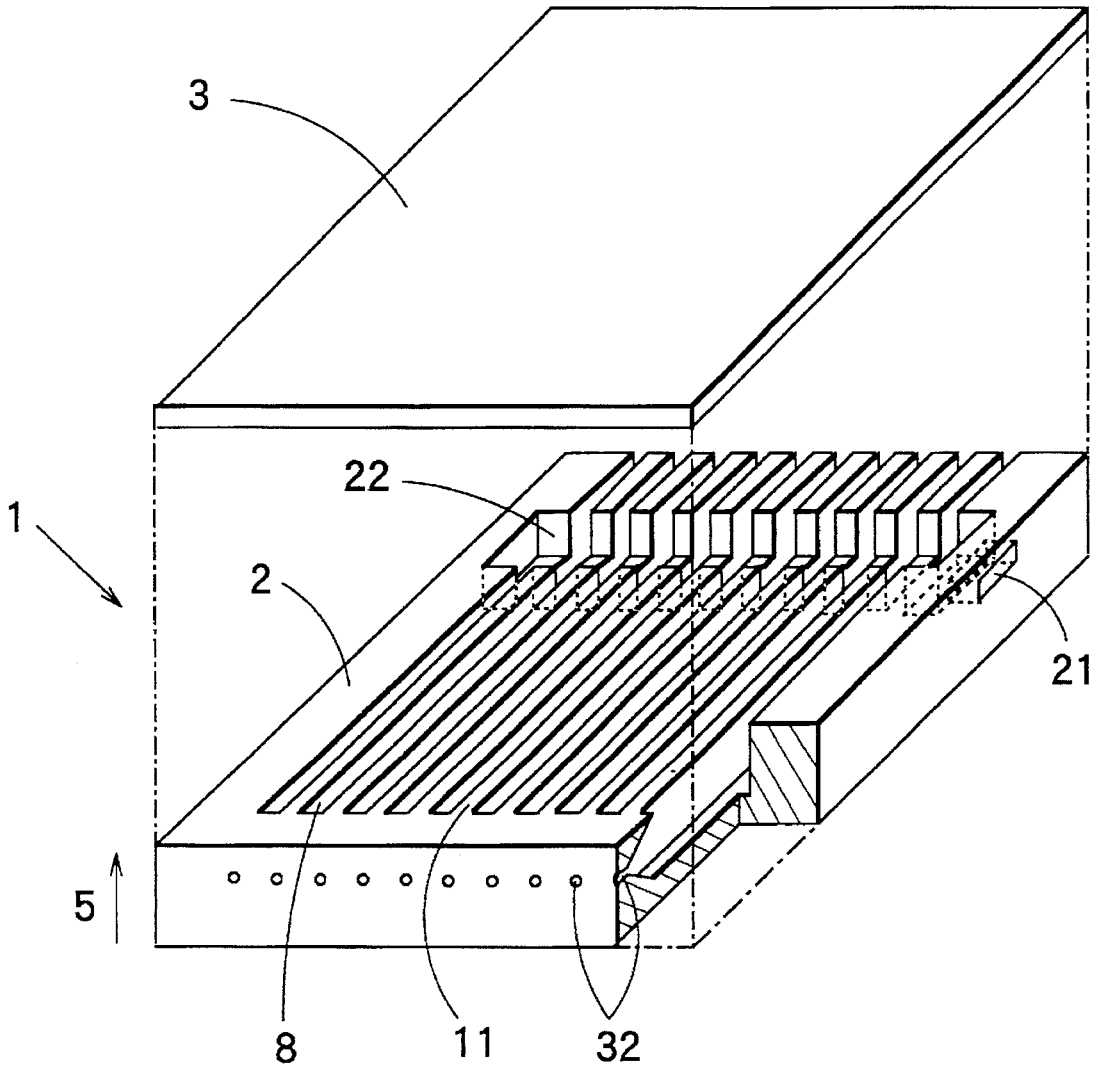
FIG. 16 is a perspective view of a piezoelectric ceramic plate for an ink jet print head according to a sixth preferred embodiment of the present invention.

As shown in FIG. 16, in a print head 1 according to a sixth preferred embodiment, the nozzles 32, grooves 8, shallow grooves 16, side walls 11, manifold 22, and ink introduction port 21 are all integrally formed in the piezoelectric ceramic plate 2 by injection molding. This piezoelectric ceramic plate 2 can be obtained by the use of a metal mold of such a form that is transcribed to the injection molding material to produce the piezoelectric ceramic molded product that has the grooves 8, the shallow grooves 16, the sidewalls 11, the nozzles 32, the ink introduction port 21 and the manifold 22. An ink jet print head produced according to the sixth preferred embodiment obtains the benefits of the print heads produced according to both the second and third preferred embodiments.

Figure 17:
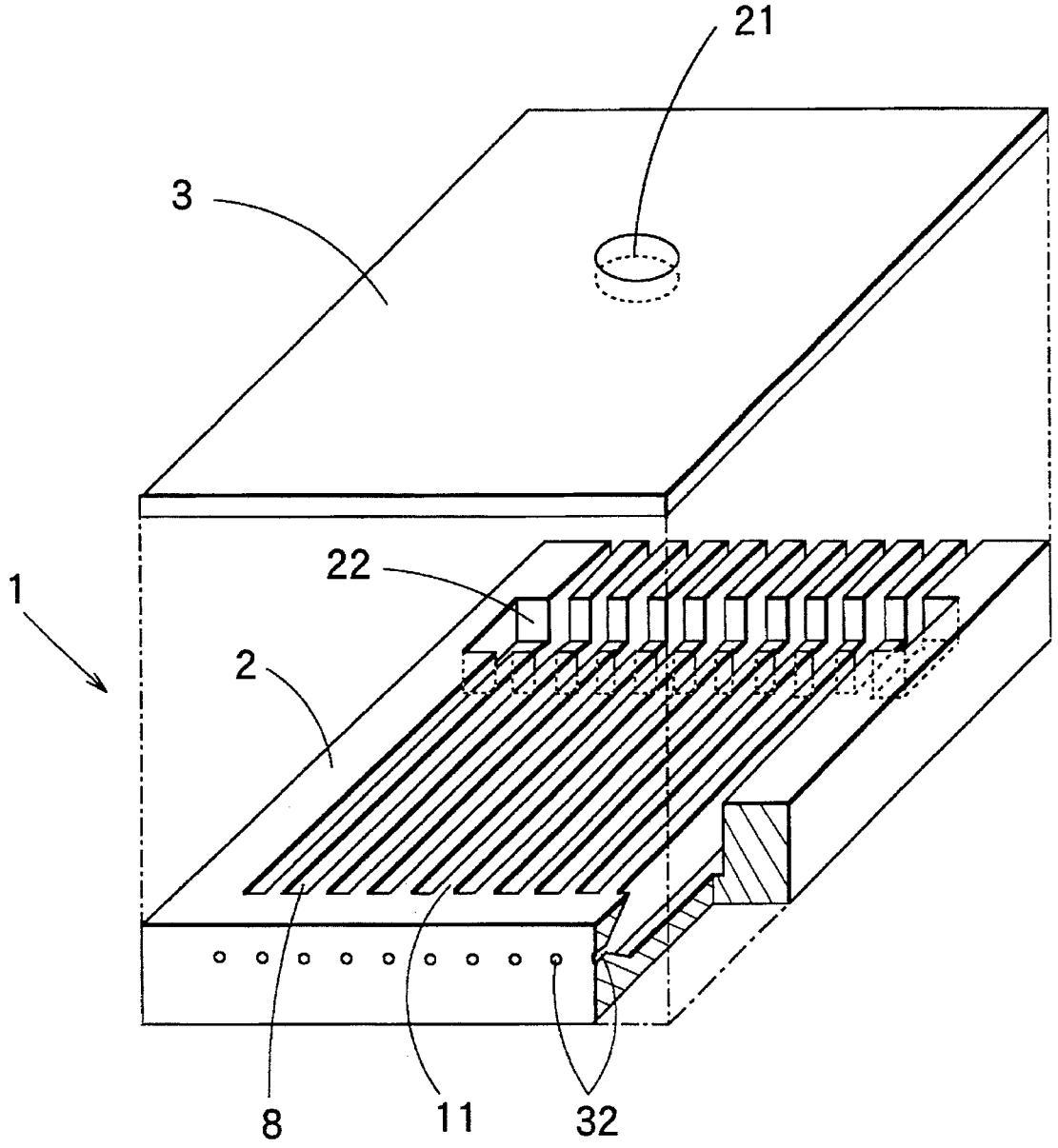
FIG. 17 is a perspective view of a piezoelectric ceramic plate for an ink jet print head according to a seventh preferred embodiment of the present invention.
Figure 18:
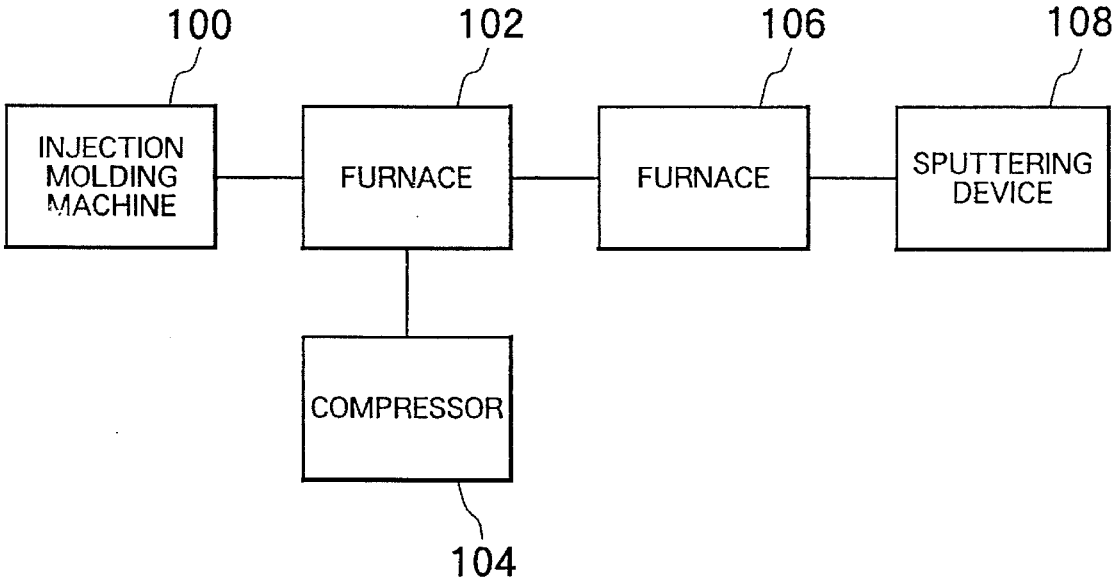
FIG. 18 is one example of a machine to form the ink jet print head.

As shown in FIG. 17, in a print head 1 according to a seventh preferred embodiment the nozzles 30, grooves 8, shallow grooves 16, side walls 11, and manifold 22 are integrally formed in the piezoelectric ceramic plate 2 by injection molding. This piezoelectric ceramic plate 2 can be obtained by the use of a metal mold of such a form that is transcribed to the injection molding material to produce the piezoelectric ceramic molded product that has the grooves 8, the shallow grooves 16, the sidewalls 11, the nozzles 32, and the manifold 22. The ink introduction port 21 is formed in the cover plate 3. An ink jet print head produced according to the seventh preferred embodiment obtains the benefits of the print heads produced according to both the second and fourth preferred embodiments.

Although FIGS. 16 and 17 shows the area near the nozzles 30 as being an angularly slanted area, the area near the nozzle could be formed curved as described in the second preferred embodiment.

While the invention has been described in detail with reference to specific embodiments thereof, it would be apparent to those skilled in the art that various changes and modifications may be made therein without departing from the spirit of the invention.

For example, though the above-described embodiments are all directed to the ink jet print head of the type as shown in FIG. 2, the present invention can be applied to various types of ink jet print heads. For example, the present invention can be applied to the ink jet print head of the type of FIG. 1. The piezoelectric ceramic element 76 may be produced through injection molding.

What is claimed is:

1. An ink ejection device for ejecting ink, comprising:

a piezoelectric ceramic plate having an ink channel for containing ink, said piezoelectric ceramic plate deforming by application of an electric voltage to change a volume of ink in the ink channel and eject ink from the ink channel, said piezoelectric ceramic plate being formed by injection molding, said piezoelectric ceramic plate having one surface with a surface roughness Rz of 1 μm or less; and a metal electrode provided on the surface of said piezoelectric ceramic plate for applying the electric voltage to said piezoelectric ceramic plate, wherein said piezoelectric ceramic plate includes at least one drive wall portion located along and defining at least a portion of the ink channel, the drive wall portion deforming upon application of the electric voltage and changing the volume of ink in the ink channel, the drive wall portion having one surface with a surface roughness Rz of 1 μm or less, said metal electrode being provided on the surface of the drive wall portion for applying the electric voltage to the drive wall portion, said piezoelectric ceramic plate including a plurality of drive wall portions located along and defining at least portions of a plurality of ink channels, further comprising a cover plate defining an ink introduction port for introducing ink toward the plurality of ink channels, said piezoelectric ceramic plate further including an ink manifold wall portion defining an ink manifold in communication with the ink introduction port for supplying the introduced ink to the plurality of ink channels, the drive wall portion and the ink manifold wall portion being integrally formed by the injection molding.

2. The ink ejection device as claimed in claim 1, wherein said piezoelectric ceramic plate further includes a nozzle wall portion having a nozzle in communication with the ink channel for ejecting an ink droplet from the ink channel by deformation of the drive wall portion, the drive wall portion and the nozzle wall portion being integrally formed by the injection molding.

3. The ink ejection device as claimed in claim 2, wherein said piezoelectric ceramic plate further includes a connecting surface for connecting the drive wall portion and the nozzle wall portion, the connecting surface being slanted.

4. The ink ejection device as claimed in claim 2, wherein said piezoelectric ceramic plate further includes a connecting surface for connecting the drive wall portion and the nozzle wall portion, the connecting surface being curved.

5. The ink ejection device as claimed in claim 2, wherein said piezoelectric ceramic plate further includes an ink introduction port wall portion having an ink introduction port for introducing ink toward the ink channel, the ink introduction port wall portion being integrally formed with the drive wall portion and the nozzle wall portion by the injection molding.

6. The ink ejection device as claimed in claim 5, wherein said piezoelectric ceramic plate includes a plurality of drive wall portions located along and defining at least portions of a plurality of ink channels, and wherein said piezoelectric ceramic plate further includes an ink manifold wall portion defining an ink manifold in communication with the ink introduction port for supplying the introduced ink to the plurality of ink channels, the ink manifold wall portion being integrally formed with the drive wall portion, the nozzle wall portion and the ink introduction port wall portion by the injection molding.

7. The ink ejection device as claimed in claim 1, wherein said piezoelectric ceramic plate further includes an ink introduction port wall portion having an ink introduction port for introducing ink toward the ink channel, the drive wall portion and the ink introduction port wall portion being integrally formed by the injection molding.

8. The ink ejection device as claimed in claim 7, wherein said piezoelectric ceramic plate further includes a nozzle wall portion having a nozzle in communication with the ink channel for ejecting an ink droplet from the ink channel by deformation of the drive wall portion, the nozzle wall portion being integrally formed with the drive wall portion and the ink introduction port wall portion by the injection molding.

9. The ink ejection device as claimed in claim 7, wherein said piezoelectric ceramic plate includes a plurality of drive wall portions located along and defining at least portions of a plurality of ink channels, and wherein said piezoelectric ceramic plate further includes an ink manifold wall portion defining an ink manifold in communication with the ink introduction port for supplying the introduced ink to the plurality of ink channels, the ink manifold wall portion being integrally formed with the drive wall portion and the ink introduction port wall portion by the injection molding.

10. The ink ejection device as claimed in claim 1, wherein said piezoelectric ceramic plate further includes a nozzle wall portion having a nozzle in communication with the ink channel for ejecting an ink droplet from the ink channel by deformation of the drive wall portion, the nozzle wall portion being integrally formed with the drive wall portion and the manifold wall portion by the injection molding.

11. A method of producing an ink ejection device for ejecting ink, the ink ejection device including at least one drive wall located along and defining at least a portion of an ink channel for containing ink and for deforming upon application of an electric voltage to change the volume of ink in the ink channel and eject ink from the ink channel, the ink ejection device further including a metal electrode provided on a surface of the drive wall for applying the electric voltage to the drive wall, the method comprising the steps of:

injection molding the drive wall from piezoelectric ceramic material so the drive wall has at least one surface with a surface roughness Rz of 1 μm or less, the drive wall located along and defining at least the portion of the ink channel for containing ink, the drive wall capable of deforming upon application of an electric voltage to change the volume of ink in the ink channel and eject ink from the ink channel; and forming a metal electrode on the surface of said piezoelectric ceramic plate, the metal electrode being capable of applying an electric voltage to said piezoelectric ceramic plate, wherein the ink ejection device further includes a nozzle wall having a nozzle in communication with the ink channel for ejecting an ink droplet from the ink channel by deformation of the drive wall, and wherein said injection molding step integrally forms the drive wall and the nozzle wall from the piezoelectric ceramic material by injection molding, the ink ejection device further including an ink introduction port wall defining an ink introduction port for introducing ink toward the ink channel, and wherein said injection molding step integrally forms the drive wall, the nozzle wall and the ink introduction port wall from the piezoelectric ceramic material by injection molding, wherein the ink ejection device includes a plurality of drive walls located along and defining at least portions of a plurality of ink channels and further includes an ink manifold wall defining an ink manifold in communication with the ink introduction port for supplying the introduced ink to the plurality of ink channels, and wherein said injection molding step integrally forms the drive wall, the nozzle wall, the ink introduction port wall and the ink manifold wall from the piezoelectric ceramic material by the injection molding.

12. An apparatus for producing an ink ejection device for ejecting ink, the ink ejection device including at least one drive wall located along and defining at least a portion of an ink channel for containing ink and for deforming upon application of an electric voltage to change the volume of ink in the ink channel and eject ink from the ink channel, the ink ejection device further including a metal electrode provided on a surface of the drive wall for applying the electric voltage to the drive wall and an ink manifold wall defining an ink manifold in communication with an ink introduction port for supplying introduced ink to the channel, the apparatus comprising:

means for injection molding the drive wall from piezoelectric ceramic material so the drive wall has at least one surface with a surface roughness Rz of 1 μm or less, the drive wall located along and defining at least the portion of the ink channel for containing ink, the drive wall capable of deforming upon application of an electric voltage to change the volume of ink in the ink channel and eject ink from the ink channel; and means for forming a metal electrode on the surface of the drive wall, the metal electrode capable of applying an electric voltage to the drive wall, wherein the drive wall and the ink manifold wall are integrally formed by injection molding.

* * * * *